United States Patent [19]

Van Horn, II

[11] 4,340,106

[45] Jul. 20, 1982

[54] STRIP DOOR HANGING SYSTEM

[75] Inventor: William E. Van Horn, II, Pomona, Calif.

[73] Assignee: Cool Curtain, Inc., Pomona, Calif.

[21] Appl. No.: 130,460

[22] Filed: Mar. 14, 1980

[51] Int. Cl.[3] ..... A47H 1/00

[52] U.S. Cl. ..... 160/332; 24/201 C; 24/201 HH; 248/214; 248/221.3; 248/225.2; 160/184

[58] Field of Search ..... 160/332, 327, 328, DIG. 15, 160/184, 384; 24/7, 8, 81 R, 73 HH, 73 MF, 201 HH, 201 C; D8/354–356, 349, 394, 395; 248/221.3, 221.4, 317, 339, 340, 489, 496, 214, 215; 52/510, 511, 530, 202, 288, 273

[56] References Cited

U.S. PATENT DOCUMENTS

| | | | |
|---|---|---|---|
| 3,249,150 | 5/1966 | Knight | 160/332 X |
| 3,264,793 | 8/1966 | Schlensker | 52/511 |
| 3,373,464 | 3/1968 | Ausnit | 160/327 |
| 3,459,234 | 8/1969 | Richter et al. | 24/201 C |
| 3,638,286 | 2/1972 | Eichberg | 24/201 C |
| 4,165,778 | 8/1979 | Smith | 160/332 |

FOREIGN PATENT DOCUMENTS

| | | | |
|---|---|---|---|
| 1020143 | 11/1977 | Canada | 248/215 |

*Primary Examiner*—C. J. Husar
*Assistant Examiner*—Cherney S. Lieberman
*Attorney, Agent, or Firm*—Knobbe, Martens, Olson, Hubbard & Bear

[57] ABSTRACT

The individual strips of a plastic strip door hang by clips having a downwardly facing U-shaped portion which snap within an upwardly facing U-shaped portion on a support member so that strips may be easily installed and replaced.

1 Claim, 4 Drawing Figures

Fig. 1
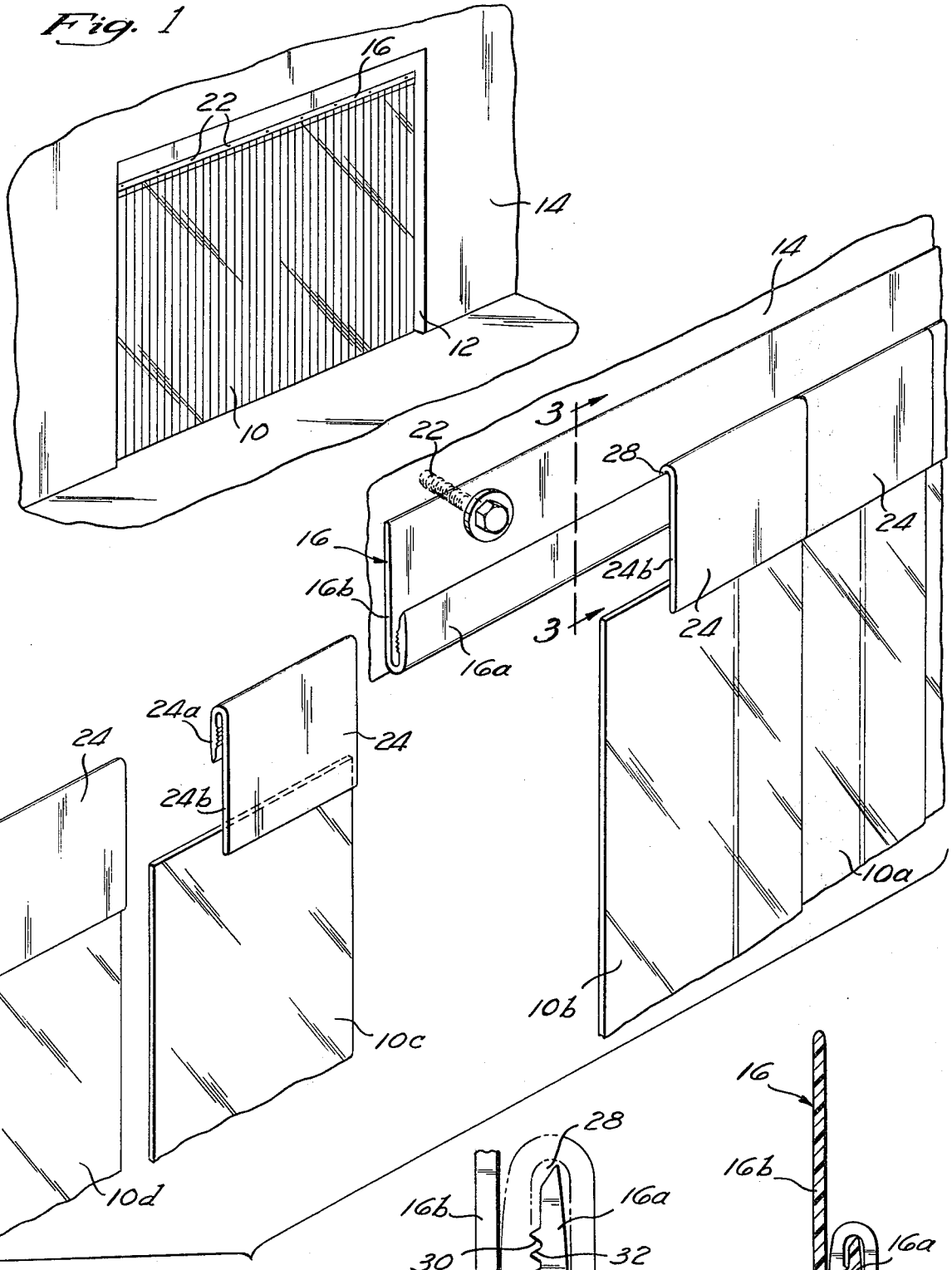
Fig. 2
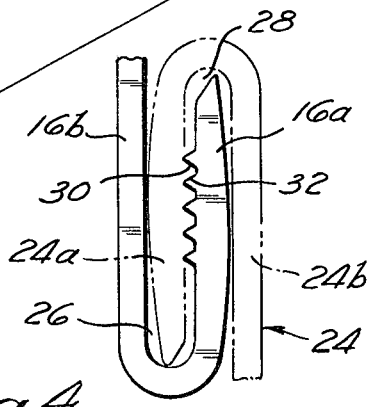
Fig. 4
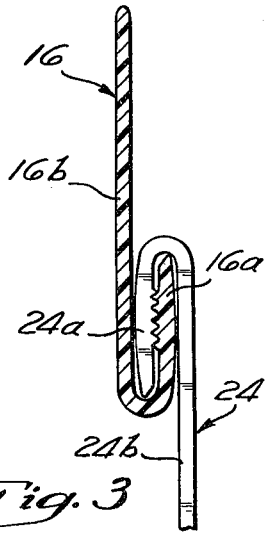
Fig. 3

STRIP DOOR HANGING SYSTEM

This invention relates to an improved system for hanging strips of a strip door wherein a plurality of flexible strips are hung in side by side, usually overlapping relation.

In recent years strip doors have been increasingly used, primarily because of their energy saving characteristics. Strip doors made of a plurality of heavy, transparent plastic strips provide an effective thermal, see-through barrier but yet permit a person to walk through the door without using hands, after which the heavy plastic strips will simply fall back into closed position. This system thus helps prevent heat or cold transfer through the door. For example, such doors are effective in minimizing cold loss from a cold storage room or preventing heat loss from an interior room to a colder exterior when the outside air is cold.

A number of different systems have been developed for supporting the plastic strips. In one of the earlier approaches, the plastic strips are clamped between two metal mounting bars and the entire assembly is then mounted on the wall. This approach has the disadvantage that the entire assembly has to be moved, if a single strip has to be replaced; and the assembly and disassembly operation takes a considerable amount of time, usually requiring two people.

In an approach set forth in U.S. Pat. No. 4,095,642 dated June 20, 1977, a loop is formed on the upper end of the plastic strip simply by doubling over the upper end of the strip, and the strips are then slid edgewise onto a supporting rod. This system has a number of advantages but still requires access to at least one end of the rod to remove a strip that needs replacement and also requires removing each additional strip that precedes the one to be replaced.

The present invention provides an improved system that is simple and direct, makes the strips easy to install and easy to replace, and also provides certain manufacturing economies. In accordance with the invention, a clip is bonded or otherwise attached to the upper end of each strip, with the clip having a downwardly opening U-shaped portion on its upper end. The clip mates with a similar U-shaped portion on a support member secured above the doorway so that each strip is simply hung on the support member. The mating portions fit snugly but yet a clip can be easily removed for replacement purposes.

Preferably the support member has an identical cross-section to the support clips such that the support structure may be extruded from plastic in a continuous length and then simply cut into clips of a desired length and a support member of desired length. The support member is typically as wide or a little wider than the doorway, and the width of a support clip would be adequate for the width of one strip.

Referring to the drawings,

FIG. 1 illustrates a perspective somewhat schematic view of a strip door positioned in a wall opening;

FIG. 2 is an exploded, perspective view of a portion of the strip door illustrating the structure for supporting the strips;

FIG. 3 is a cross-sectional view of the support member above the doorway and an elevational view of one of the strip support clips, taken along line 3—3 of FIG. 2; and FIG. 4 is an enlarged elevational view of the U-shaped portion of the support member and an elevational view of the U-shaped portion of one of the clips shown in phantom, mating with the support member.

Referring to FIG. 1, there is illustrated a plurality of plastic strips 10 extending across an opening 12 and a wall 14, the plastic strips being hung from above by a support member 16 to provide a moveable door for the opening. The particular door opening illustrated is quite wide, representing the large opening on a loading ramp such as in a warehouse.

The individual strips are made of convenient width, typically four, six or eight inches. As seen from FIG. 2, the strips are arranged in side-by-side overlapping arrangement. That is, strip 10*a* is overlapped by strip 10*b*, and strip 10*c* will overlap strip 10*b*, and end strip 10*d* will overlap strip 10*c*.

The elongated support member 16 is attached to the wall above the doorway opening by a plurality of bolts, or other fasteners, one of which is illustrated at 22. As can be seen, the member 16 includes a longer leg 16*b* and a shorter leg 16*a* connected at the lower end to form the lower U-shaped portion. The upper part of the leg 16*b* forms a support through which the bolt 22 extends. As viewed from FIG. 2 and 3, it can be seen that the overall cross-section of the support member 16 is somewhat J-shaped, although positioned backwards from the position shown in FIGS. 2 and 3, and although the lower end of the J-shape has its legs closer together than would a normal J-shaped. As can be seen, the height of the leg 16*b* is about a third of the height of the leg 16*a*.

A support clip 24 is attached by heat bonding or other suitable means to the upper end of each strip 10. The cross-section of the clip 24 is identical to that of the support member 16 except that it is inverted with respect to the support member. Thus, the U-shaped portion formed of legs 24*a* and 24*b* opens downwardly and the lower end of the clip leg 24*b* is attached to the strip. With this arrangement, the strips are simply attached to the support member 16 by hanging the clip U-shaped portion on the U-shaped portion of the support member. More specifically, each U-shaped portion formes a slot between its opposing legs and the shorter leg 24*a* of the clip 24 fits within the slot 26 formed by the legs 16*a* and 16*b* on the support member 16, and similarly the shorter leg 16*a* of the support member fits within the slot 28 formed by the legs 24*a* and 24*b* of the clip. The thickness of the shorter legs with respect to the width of the slots is such tht the clip legs may be easily snapped into position, but yet there is an interference fit so that the clips are snugly retained within the support member. To further enhance this arrangement, the inner surface of the shorter leg 24*a* of the clip and the inner wall of the shorter leg 16*a* of the support member are provided with a plurality of transversely extending ribs 30 and grooves 32 which mate with the ribs and grooves of the other element so that the clip must be snapped into position and the ribs and groove help hold the clips in the fully inserted position.

The inner surface of the free end of the shorter leg on the clip and support member is tapered or beveled in a manner which helps the shorter legs to be guided into the slot of the other member.

The support member and clips are preferably made of plastic such as a rigid polyvinyl chloride, and since the cross-section of the clip and the support member is identical, they may be extruded in a continuous length and then cut as desired.

As mentioned, the shorter leg of the cross-section is about a third of that of the longer leg, but there is still substantial height to the shorter leg so that when the clips are fully installed in the support member they do not move very much when a person passes through the strip door. That is, the flexible plastic strips move while the clips remain relatively stable with each strip flexing near its juncture with the clip. Also, in view of the height if the shorter leg with respect to the longer leg, clips on the strip in the area of the fastening member may also be easily removed in that sufficient clearance is provided between the upper end of the shorter leg of the support member and the fastener. Of course, a strip and its clip may be removed from the support member by sliding the clip laterally off the end of the support member; however, normally a clip may be installed and removed by simply being moved downwardly or upwardly with respect to the support member. A clip may be easily removed by tapping its lower end gently with a hammer or by pushing very firmly. To prevent transverse movement of the clips during use of the door, a suitable stop (not-shown) may be positioned at the edge of the support member U-shaped portion.

The width of a clip will normally be equal to the width of the strip minus the overlap portion. Thus, in the arrangement shown in FIG. 2, the clip is $\frac{3}{4}$ the width of the strip, leaving $\frac{1}{4}$ of the width without a clip for the overlap arrangement. This results in a continuous series of clips without spacing as may be seen from FIG. 2. The end strip 10*d* is shown having a clip equal to the width of the strip to provide a finished appearance in that area.

What is claimed is:

1. A strip door assembly comprising:

a plurality of flexible, elongated relatively heavy plastic strips, and means for supporting said strips from above in a side by side overlapping arrangement to form a door or curtain which provides a barrier across a doorway but yet permits passage therethrough by simply pushing through the strips, said supporting means includes an elongated support member for attachment to a wall or other supporting surface over the doorway, said support member having a first, flat elongated leg that engages the supporting surface and extends across the doorway and a second flat elongated leg that is generally parallel to the first leg, and joined at its lower end to the first leg so that they form a generally U-shaped portion with an elongated slot between the legs opening upwardly, the first leg being considerably longer in the vertical direction than that of the second leg, and a support clip having a first leg attached to the upper end of each of said strips and a second leg shorter than the first clip leg, said clip legs forming an upper U-shaped portion having a slot which opens downwardly, said U-shaped portions fitting together so that the shorter leg of the U-shaped portion on said clip releaseably fits into the slot of said U-shaped portion on said support member to thereby support the strip, and the shorter leg of the support member fits into the slot of the clip U-shaped portion, said U-shaped portions include laterally extending grooves on their inner surfaces, and the thicknesses and dimensions of the U-shaped portions are such that the clips must be pressed into engagement with the support member and said grooves help hold the clips in the engaged position, said clips and said support member being made of plastic and having an identical cross-section wherein they may be extruded in continuous lengths and cut to a desired length, the clips being inverted with respect to said support member when the U-shaped portions are engaged, the vertical depth of the slots of said U-shaped portions and the closeness of the fit being sufficient to prevent the clips from moving significantly when a force is applied to the strip in an inward or outward direction as a person passes through the strip door, the width of said clips being equal to the width of said strips minus the width of the strip that overlaps the adjacent strip, whereby the clips are in edge to edge relation in a completed door assembly.

* * * * *